United States Patent [19]

Boren

[11] Patent Number: 5,029,348

[45] Date of Patent: Jul. 9, 1991

[54] HEAD CONSTRUCTION FOR A PONTOON BOAT

[75] Inventor: Randall S. Boren, West Melbourne, Fla.

[73] Assignee: Brunswick Corporation, Skokie, Ill.

[21] Appl. No.: 410,599

[22] Filed: Sep. 21, 1989

[51] Int. Cl.[5] ..... A47K 11/02; A47K 4/00

[52] U.S. Cl. ..... 4/449; 4/476; 4/664; 4/460; 4/312

[58] Field of Search ..... 4/449, 460, 474, 476, 4/514, 599, 600, 663, 664, 312, 300, 32.1; 52/34, 35; 135/113, 88; 296/165, 173

[56] References Cited

U.S. PATENT DOCUMENTS

| | | | |
|---|---|---|---|
| 1,379,318 | 5/1921 | Steinkamp | 4/664 |
| 1,425,391 | 8/1922 | La Munyon | 4/460 |
| 1,538,296 | 5/1925 | McDonald | 4/460 |
| 1,574,339 | 2/1926 | Bush | 4/460 |
| 1,575,131 | 3/1926 | Schumacher | 4/460 |
| 3,325,206 | 6/1967 | Carlson | 135/88 |
| 4,065,885 | 1/1978 | Blick, III et al. | 4/460 |
| 4,310,194 | 1/1982 | Biller | 135/88 |
| 4,653,125 | 3/1987 | Porter | 4/664 |
| 4,710,989 | 12/1987 | Grenthe | 4/449 |
| 4,854,261 | 8/1989 | Goldsmith | 114/363 |
| 4,866,794 | 9/1989 | Davies | 4/599 |
| 4,883,016 | 11/1989 | Larson | 4/599 |

*Primary Examiner*—Henry J. Recla
*Assistant Examiner*—Keith Kupterschmid
*Attorney, Agent, or Firm*—Andrus, Sceales, Starke & Sawall

[57] ABSTRACT

A head construction for a pontoon boat comprising a housing having an open top and an open front and a toilet is mounted within the housing. A lid is hinged to the rear edge of the housing and is movable between a horizontal, closed position and an open position where the lid extends vertically. A foldable frame is secured to the housing and can be moved between a folded retracted position, where the frame is located within the housing, to an extended position where the frame extends verticallly a substantial distance above the housing. A flexible curtain interconnects the undersurface of the lid and the frame and the lower end portion of the curtain is disposed within the open front end of the housing. When the lid is moved to the open position, the frame can be pivoted from the retracted to the extended position where the curtain provides an enclosure. The front surface of the curtain is provided with a closable slit to enable a person to enter the enclosure which provides complete privacy for a person using the head.

17 Claims, 2 Drawing Sheets

FIG. 1
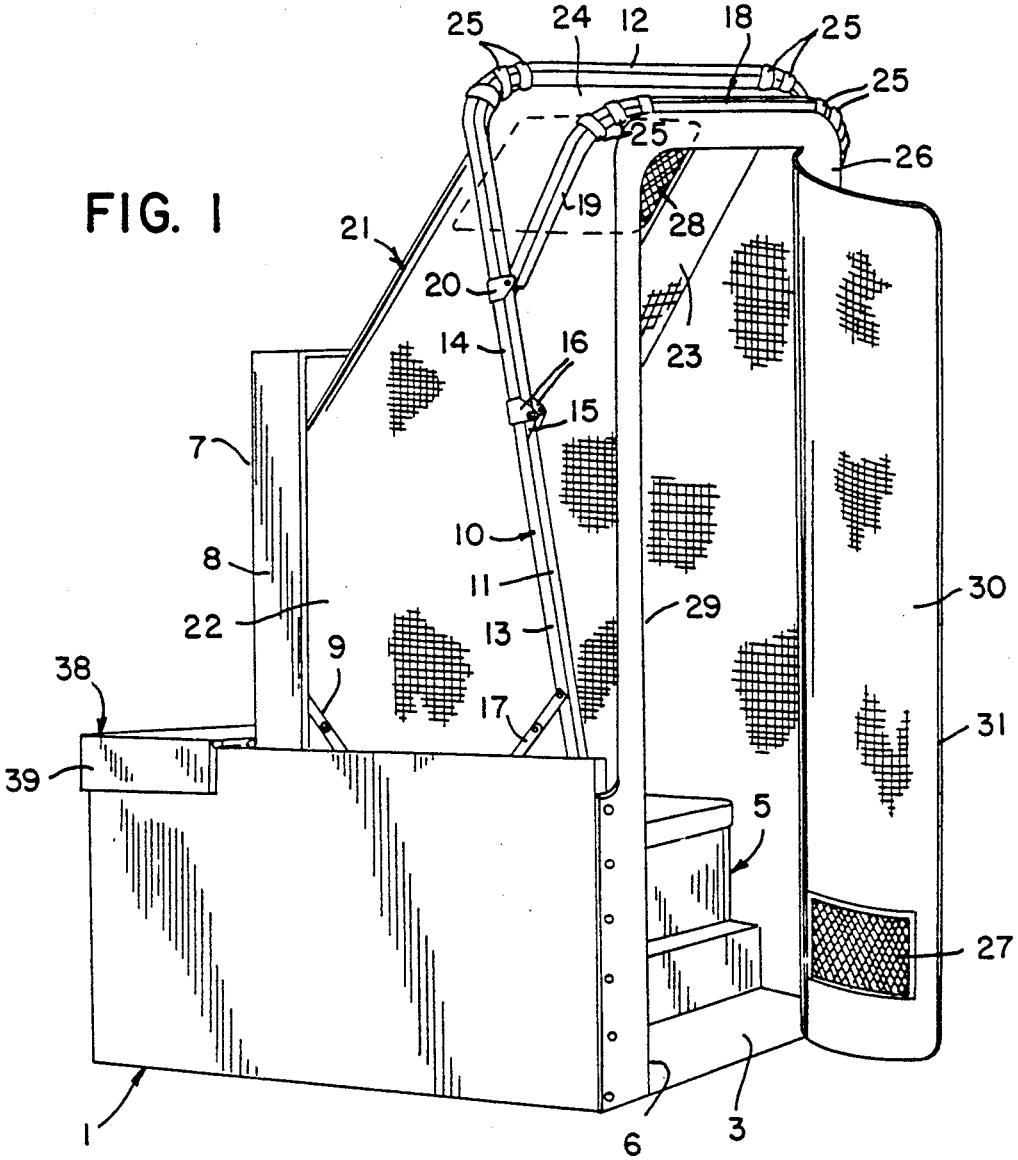
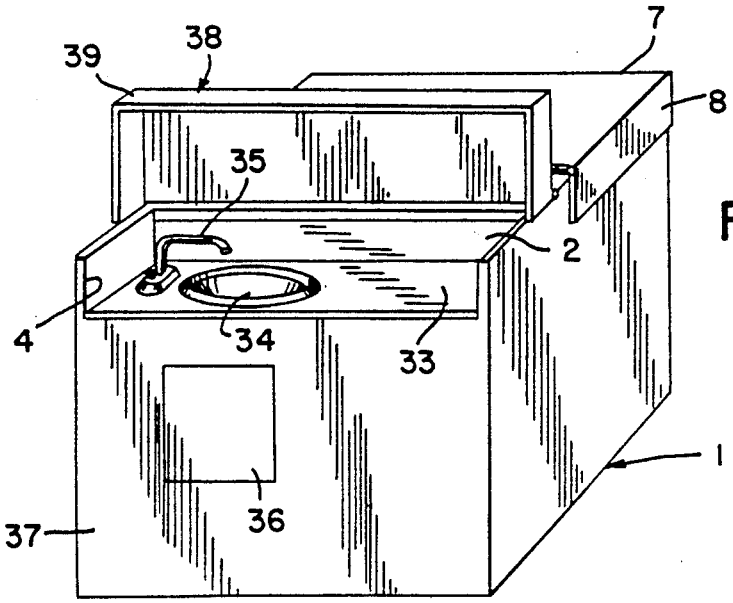
FIG. 2

HEAD CONSTRUCTION FOR A PONTOON BOAT

BACKGROUND OF THE INVENTION

Pontoon boats generally have an open deck without a cabin. Because of the open deck, problems have arisen in incorporating a head that will provide complete privacy.

It has been proposed in the past to mount a bench or seat on the deck, with the seat having an open top which is enclosed by a hinged lid, and a toilet is mounted within the seat. The undersurface of the lid carries a circular hoop and when the lid is pivoted to the vertical open position, the hoop will be generally horizontal. A flexible curtain is attached to the hoop and the curtain is slit vertically to enable a person to enter the space bordered by the curtain. However, with a construction of this type, the curtain does not enclose the entire body, so that the head and upper portion of the body are exposed. As a result, heads of this type have not proven satisfactory, because they do not provide complete privacy and cause embarassment to the person using the head.

Because of this, there has been a need for a head to be incorporated with an open-deck pontoon boat and which will provide complete privacy for the user.

SUMMARY OF THE INVENTION

The invention is directed to a head construction having particular use with an open deck pontoon boat. The head comprises a generally box-shaped housing or bench having an open top and an open front, and a toilet is mounted within the housing. Hinged to the rear edge of the housing is a lid that can be pivoted between a generally horizontal closed position and a vertical open position. A metal frame is secured to the housing and, when the lid is open, can be moved from a folded retracted position where the frame is located within the housing, to an extended position where the frame extends vertically a substantial distance above the housing.

A flexible curtain made of plastic, canvas, or the like, interconnects the undersurface of the lid and the frame and the lower portion of the front surface of the curtain is disposed within the open front end of the housing. The front surface of the curtain is provided with a slit that can be enclosed by a zipper or other fastener, and the slit provides access to the interior of the curtain when the frame is in the extended position.

When the frame is in the extended position, the curtain will completely enclose the user of the head to provide complete privacy, thus eliminating possible embarassment to the user.

In a stowed condition, the head is contained completely within the confines of the housing, so that it is not obstrusive. By incorporating a padded cushion with the lid, the housing, with the lid in the closed position, can be used as a seat.

As a further feature of the invention, the housing can also be provided with a second compartment enclosed by a hinged lid that can be moved from a horizontal closed position to a vertical open position. The second compartment can house a sink and faucet, or other equipment, such as a bottle storage rack, cooler, or the like.

Other object and advantages will appear in the course of the following description.

DESCRIPTION OF THE DRAWINGS

The drawings illustrate the best mode presently contemplated of carrying out the invention.

In the drawings:

FIG. 1 is a perspective view of the head construction of the invention showing the frame in the extended position;

FIG. 2 is a perspective view of the opposite end of the housing showing the head in the stored position and the lid for the sink compartment in the open position;

DESCRIPTION OF THE ILLUSTRATED EMBODIMENT

Figure 3:
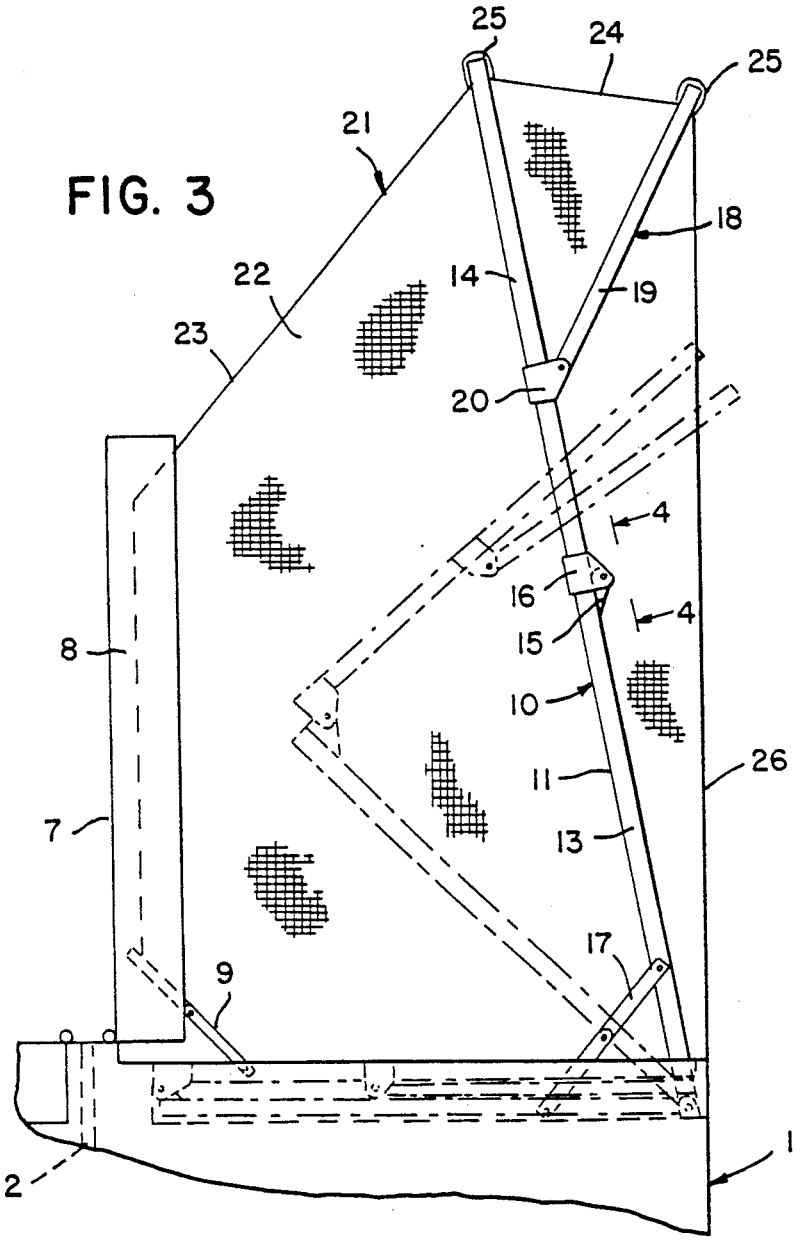
FIG. 3 is a fragmentary side elelvation of the head in the extended position.
Figure 4:
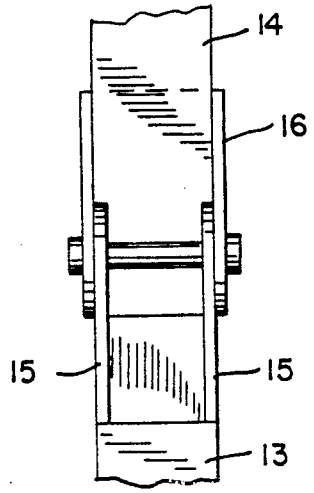
FIG. 4 is a section taken along line 4—4 of FIG. 3 and showing the connection between the leg sections of the frame.

The drawings illustrate a head construction that has particular use with an open-deck pontoon boat. The construction includes a housing 1 having a vertical divider wall 2 that divides the housings into a pair of compartments 3 and 4. A standard marine toilet 5 is located within the compartment 3.

Housing 1 is provided with an open end 6 and an open top which is enclosed by a hinged lid 7. Lid 7 is formed with a peripheral flange 8 and when the lid is in the closed position, as shown in FIG. 2, the flange 8 overlaps the sides of housing 1. Lid 7 can be pivoted from a closed horizontal position, as seen in FIG. 2, to an open vertical position, as shown in FIG. and locked in the open position by a toggle linkage 9.

A folding metal frame is attached to the housing and is movable between a retracted or storage position, where the frame is located within housing 1, and an extended position, as shown in FIG. 1, where the frame extends upwardly a substantial distance above housing 1.

The frame consists of a generally U-shaped member 10, including a pair of legs 11, the upper ends of which are connected by a cross brace 12. Each leg 11 is composed of a lower leg section 13 and an upper leg section 14 which is pivoted to the lower section. To provide the pivotal connection, lugs 15 are attached to the upper end of each lower section 13 and are pivotally connected to the flanges of U-shaped brackets 16 on upper sections 14. With this construction, leg sections 13 and 14 can be pivoted between a folded condition where the sections are in parallel relation and are located within housing 1, as shown by the dashed lines in FIG. 3, to an extended position where the leg sections 13 and 14 are in end-to-end alignment, as seen in FIGS. 1 and 3. The connection of lugs 15 and bracket 16 prevents the leg sections 13 and 14 from moving beyond the in-line position.

As illustrated in FIG. 3, legs 11 of frame member 10 are located at an angle of about 20° from the vertical when the frame is in the extended position, and the frame can be locked in the extended position by a toggle linkages 17, which connect each lower leg section 13 with the respective sides of housing 1.

A second generally U-shaped frame section 18 is pivotally connected to the upper leg sections 14. In this regard, the lower ends of legs 19 of frame section 18 are pivotally connected to brackets 20 secured to upper leg sections 14. With this mounting arrangement, frame section 18 can be pivoted from a position where it is substantially parallel to legs 11 of frame member 10 to a second angular position, as shown in FIG. 3, where it is located at an acute angle with respect to legs 11.

A flexible curtain 21 formed of fabric or plastic material is attached to the underside of lid 7 as well as to the sides of housing 1 and to members 10 and 18 when the frame is in the extended position, the curtain 21 provides a complete enclosure. More specifically, curtain 21 includes a pair of sides 22 which are connected by suitable fasteners to the upper edge of the sides of housing 1, while the rear edges of sides panels 22 are connected to the inner surface of flange 8 of lid 7.

In addition curtain 21 includes a sloping rear panel 23, the lower end of which is secured to flange 8 and a top panel 24 which extends forwardly from the upper edge of rear panel 23. Top panel 24 is connected to frame members 10 and 18 by straps 25.

Curtain 21 further includes a front panel 26 and the side edges of the lower portion of front panel 26 are connected by suitable fasteners to the edges of housing 1 bordering open end 6. As shown in FIG. 1, the lower portion of front panel 26 is provided with a vent screen 27 and similarly rear panel 23 has a vent screen 28.

To provide access to the interior of the curtain 21, front panel 26 is provided with a generally L-shaped access slit 29 and the slit 29 provides an access door 30 which can be joined to front panel 26 by a zipper 31, or other suitable fastener. As shown in FIG. 1, door 30 extends substantially the full height of the front panel 26 and provides access to the interior of the enclosure defined by curtain 21.

In the stored position, leg sections 13 and 14 of frame member 10, as well as frame member 18, are in the folded parallel position where they are located at the upper edge of housing 1. Curtain 21, being flexible, is contained within the upper end of compartment 3.

To use the head, the lid is initially pivoted upwardly to the vertical position and latched in the vertical position by toggle linkage 9. Frame member 10 is then extended by pivoting leg sections 13 and 14 from the folded parallel position to the in-line position and the lower leg sections 13 are then locked in the extended position by toggle linkage 17. Frame member 18 can then be pulled forwardly from frame member 10, so that it is at an acute angle with respect to the frame member 10 as illustrated in FIG. 3.

With the frame extended, zipper 31 is then disengaged to open the door panel 30 and provide access to the interior of the enclosure. A person entering the head can then rezip the zipper from the inside to provide a completely private head enclosure. For storage, the procedure is reversed.

Compartment 4 of housing 1 can be provided with a generally horizontal countertop 33, and a sink 34 and water faucet 35 can be mounted on the countertop. A suitable access panel 36 is provided in end wall 37 of housing 1 and provides access to a water tank and pump, which are located within the lower portion of compartment 4.

As in the case of compartment 3, compartment 4 can be enclosed by a lid 38 which is hinged to the housing and can be moved between a horizontal closed position and a vertical open position, as shown in FIG. 2. Lid 38 is provided with a peripheral downwardly extending flange 39, which, when lid 38 is closed, will overlap the side walls of the housing 1.

The upper surfaces of lids 7 and 38 can be padded, so that with the lids in the closed position, the padded cushions can provide a seat.

While the drawings have illustrated a sink and water faucet being mounted on countertop 33, it is contemplated that other equipment, such as a bottle rack, cooler, or the like can be mounted on the countertop 33 and enclosed by the lid 38.

With the frame extended, the curtain 21 provides a complete enclosure for a person using the head, thereby ensuring fully privacy and eliminating any possible embarassment to the user. In the stowed condition, the head construction is completely enclosed, so that it is not obtrusive and can be used as a padded seat.

Various modes of carrying out the invention are contemplated as being within the scope of the following claims particularly pointing out and distinctly claiming the subject matter which is regarded as the invention.

I claim:

1. A marine head construction, comprising a housing defining a first compartment and having an open top and an open front end, a toilet disposed within the housing, said housing having a lid to enclose the open top, said lid being hinged to said housing and being mounted for movement between a closed position and an open position, frame means mounted on the housing, a flexible curtain interconnecting the housing and the frame means, said frame means including an inverted U-shaped first frame member having a pair of first legs and a cross brace connecting said legs together, each of said first legs being pivotally connected to said housing about a horizontal axis, said first frame member being mounted for pivotal movement between a retracted position where said first frame member is located in said first compartment and an extended position where said first frame member extends a substantial vertical distance above said housing, each leg including a pair of leg sections which are moveable from a folded position in which said leg sections are parallel to each other when said first frame member is in the retracted position to an end-to-end position when said first frame member is in the extended position, said curtain having a front surface disposed in said open front, said curtain when said first frame member is in the extended position comprising a full enclosure, and access means in said front surface to enable a person to enter said enclosure.

2. The construction of claim 1, wherein said lid has a rear end hinged to said housing.

3. The construction of claim 1 wherein said curtain is attached to said cross brace.

4. The construction of claim 1, wherein said access means comprises a slit in said front surface, and fastening means for closing said slit.

5. The construction of claim 4, wherein said fastening means comprises a zipper.

6. A marine head construction, comprising a housing defining a first compartment having an open top and an open front end, a toilet disposed within said compartment, a lid hinged to said housing and movable between a closed position where it encloses said open top and an open position, a frame mounted on the housing and movable between a retracted position within the first compartment and an extended position where the frame extends vertically a substantial distance above said housing, said frame including an inverted U-shaped frame member having a pair of legs pivotally connected to said housing about a horizontal axis and a cross brace connecting the upper ends of said legs together, each leg comprising a pair of leg sections which are movable from a folded position when the frame is in the retracted position to a generally end-to-end position when the frame is in the extended position, a flexible curtain including a front panel, a pair of side panels, and an upper panel connected to the upper edges of said side panels, said front panel extending within said open front end of said compartment, a rear portion of said upper panel being connected to said lid and said side panels being connected to both said lid and said housing, said curtain providing a complete enclosure when said frame is in the extended position, and an access slit in said front panel providing access to said enclosure.

7. The construction of claim 6, and including fastening means for closing said access slit.

8. The construction of claim 6, wherein said frame includes a second U-shaped frame member having a pair of second legs and a cross brace connecting said legs together, said second legs being pivotally connected to the legs of the first frame member.

9. The construction of claim 6, and including locking means for locking the frame in the extended position.

10. The construction of claim 6, wherein the frame when in the extended position is located solely outside of said curtain.

11. The construction of claim 6, wherein said housing is provided with a second compartment disposed adjacent said first compartment, a generally flat countertop disposed within said second compartment and disposed to support equipment, and a second lid hinged to the housing and movable between a closed position where said second lid encloses the upper end of said second compartment and an open position, said lids when in the closed position being substantially planar and constituting a seat.

12. The construction of claim 6, wherein said frame is disposed at an acute angle to a vertical plane when in the extended position.

13. The construction of claim 6, wherein each leg is composed of a pair of leg sections which are movable between a folded position where said leg sections are in parallel relation to each other and a second position where said leg sections are in end-to-end aligned relation.

14. The construction of claim 13, wherein each leg section has a length less than a front-to-rear direction of said compartment, whereby said leg sections when in the folded position are disposed within said housing.

15. The construction of claim 13, and including a second U-shaped frame member having a pair of second parallel legs and a second cross brace connecting said second legs together, each second leg being pivotally connected to one of said leg sections and movable between a folded position where said second leg is generally parallel to said one leg section to an angular position where said second leg extends at an acute angle to said one leg section.

16. A marine head construction, comprising a housing defining a first compartment and having an open top and an open front end, a toilet disposed within the housing, said housing having a lid to enclose the open top, said lid being hinged to said housing and being mounted for movement between a closed position and an open position, frame means mounted on the housing, a flexible curtain interconnecting the housing and the frame means, said frame means including an inverted U-shaped first frame member having a pair of first legs and a cross brace connecting said legs together, each of said first legs being pivotally connected to said housing about a horizontal axis, said first frame member being mounted for pivotal movement between a retracted position where said first frame member is located in said first compartment and an extended position where said first frame member extends a substantial vertical distance above said housing, said first frame means also including a second U-shaped frame member having a pair of second legs and a second cross brace interconnecting said second legs, said second legs being pivotally connected to said first legs, said curtain having a front surface disposed in said open front, said curtain when said first frame member is in the extended position comprising a full enclosure, and access means in said front surface to enable a person to enter said enclosure.

17. A marine head construction, comprising a housing defining a first compartment and having an open top and an open front end, a toilet disposed within the housing, said housing having a lid to enclose the open top, said lid being hinged to said housing and being mounted for movement between a closed position and an open position, frame means mounted on the housing, a flexible curtain interconnecting the housing and the frame means, said frame means including an inverted U-shaped first frame member having a pair of first legs and a cross brace connecting said legs together, each of said first legs being pivotally connected to said housing about a horizontal axis, said first frame member being mounted for pivotal movement between a retracted position where said first frame member is located in said first compartment and an extended position where said first frame member extends a substantial vertical distance above said housing, said curtain having a front surface disposed in said open front, said curtain when said first frame member is in the extended position comprising a full enclosure access means in said front surface to enable a person to enter said enclosure, said housing also including a second compartment disposed adjacent said first compartment, a horizontal countertop extending across said second compartment and disposed to support equipment, and a second lid hinged to said housing and movable between a closed position where it encloses an upper end of said second compartment and an open position.

* * * * *